United States Patent [19]

Fischer

[11] 4,430,564

[45] Feb. 7, 1984

[54] IMAGE CONVERSION APPARATUS WITH GAS DISCHARGE SWITCHING

[75] Inventor: Dieter Fischer, Frankfurt, Fed. Rep. of Germany

[73] Assignee: Triumph-Adler A.G. für Büround Informationstechnik, Nuremburg, Fed. Rep. of Germany

[21] Appl. No.: 271,620

[22] Filed: Jun. 8, 1981

[51] Int. Cl.[3] ..... H01J 40/14

[52] U.S. Cl. ..... 250/211 R; 250/578; 315/169.4

[58] Field of Search ..... 250/578, 211 R, 211 J, 250/213 VT, 374, 213 R; 313/100; 357/24 LR, 31, 32; 315/169.4

[56] References Cited

U.S. PATENT DOCUMENTS 2,925,530 2/1960 Engelbart ..... 315/169.4

4,079,422 3/1978 Anagnostopoulos ..... 250/578

*Primary Examiner*—David C. Nelms

*Attorney, Agent, or Firm*—Joseph R. Spalla

[57] ABSTRACT

An image conversion apparatus has a line array of light responsive circuits connected in parallel across a voltage source. Each circuit comprises the capacitance of an elemental area of a photoconductive insulating layer arranged in series with a capacitor which is shunted by a normally open switch. The levels to which charge is distributed in the capcitance of the photoconductive insulating layer and in its associated capacitor is related to the quantity of light incident on the elemental area of the photoconductive insulating layer over intervals an associated switch is open. Closure of a switch serves to discharge its associated capacitor and to cause the capacitance of the photoconductive insulating layer to charge to the voltage of a source from a lower level obtained during open switch intervals. The magnitude of the charging current is related to the quantity of light incident on the elemental area of the photoconductive insulating layer. The switches take the form of gas spaces which are ignitable in turn by read pulses whereby a signal train of individual pulses of magnitudes corresponding to light incident on discrete circuits in the array is generated.

9 Claims, 11 Drawing Figures

IMAGE CONVERSION APPARATUS WITH GAS DISCHARGE SWITCHING

This invention relates to image conversion apparatus; more particularly it relates to an image conversion apparatus of high resolution having a line array of light responsive circuits each of which responds to light from a discrete point along a line of a relatively moving original document to be scanned; and specifically to an image conversion apparatus wherein each of said circuits comprises the capacitance defined by an elemental area of a photoconductive insulating layer connected in series with a capacitor across a voltage source with a gas space arranged, when ignited, to short said capacitor whereby the resulting charging current to the capacitance of the associated photoconductive insulating layer, proportional to the quantity of light incident thereon, is measured.

Apparatus for horizontally scanning strips of an original image point by point for conversion to electrical signals using a linear array of charge coupled devices (CCD's) consisting of a shift register arrangement with 1728 devices are known. When scanning a DIN A 4 size page of 210 mm width with such an array a resolution of 8 dots per millimeter can be obtained. However, as the length of such an array is on the order of 25 mm, to scan the DIN A 4 size page requires optical reduction of the image and, as optics require significant space, the advantage due to the small size of the CCD's is not realized.

Further, the construction of a CCD array differs from the construction of known apparatus for recording the serial dot video signals generated at the output of the CCD array. The different constructions require different manufacturing techniques which preclude cost efficiencies.

In accordance with the invention there is provided an array of discrete light responsive circuits; the array being of a length equal to the width of an image to be scanned. The array is constructed to include on the order of 10 circuits per millimeter thus allowing high resolution 1:1 scanning without the necessity for optical reduction of the image. Each circuit in the array comprises the capacitance of a photoconductive insulator in series with a capacitor which is shunted by a switch. All of the circuits are arranged in parallel and connected across a voltage source. According to the dot resolution desired the ground plate of the capacitor and the insulating layer between the plates of the capacitor are preforated to define gas gaps each of which is in communication with an associated gas chamber bounded by the ground plate of the capacitor and a discrete electrode spaced from the ground plate. Upon application of a negative voltage pulse of sufficient magnitude across an electrode and associated capacitor ground plate, ionization of the gas in the associated gas chamber will occur for the duration of the pulse resulting in a discharge or a current flow to the ground plate, and, if there is any charge across the capacitor, in a discharge of said capacitor across the gas gap.

With source voltage applied and light incident on the circuits, both the capacitance of the photoconductive insulating layer and the capacitor will be charged to levels determined by the intensity and period of application of the incident light. When a switch associated with a discrete light responsive circuit is closed and its capacitor is discharged, the level of charge stored in the capacitance of the photoconductive insulator will rise to the voltage of the source, with the magnitude of the change representing the light incident on the discrete circuit. When the switch is again opened a current will flow over the switch open interval in an amount proportional to light, reducing the charge stored in the capacitance of the photoconductive insulator and increasing the charge in the capacitor until the switch is again closed to read out its associated circuit.

The light responsive circuits of the array are scanned or read out in turn by applying read pulses to three switching lines. More particularly, the first, fourth, seventh, etc. circuits are connected to one switching line, the second, fifth, eighth, etc., to a second switching line, and the third, sixth, ninth, etc. to a third switching line. Three phase displaced trains of voltage pulses of sufficient magnitude are applied to the switching lines to discharge the gas chambers and effect switch closures from left to right in turn. To assure that only one gas chamber at a time is ignited, the magnitude of the read voltage pulses on the switching lines is not sufficient to effect ionization and breakdown of a gas chamber, unless it is conditioned or primed by the introduction of ions as a result of ionization and discharge in the last adjacent gas chamber. Thus, channels connecting gas chambers in the array are provided to carry ions from a discharged gas chamber into the next following gas chamber.

Initially, ions are introduced into the first gas chamber of the array of circuits to lower its breakdown potential whereby discharge will occur upon application of a read voltage pulse of a magnitude normally insufficient to effect discharge. The discharge in the first gas chamber will prime the second gas chamber with discharge therein priming the third, etc., whereby the image exposed array is serially scanned.

An object of the invention is in the provision of a 1:1 image converter.

Another object of the invention is in the provision of a 1:1 image converter capable of high resolution without the necessity for optical reduction of the image to be converted.

A further object of the invention is in the provision of a visual to electronic image converter capable of high speed line-scanning.

A further object of the invention is to provide an image converter having parts common to a recorder to enable cost efficient manufacture of both units.

Other objects, features and advantages of the present invention will become known to those skilled in the art from a reading of the following detailed description when taken in conjunction with the accompanying drawing wherein like reference numerals designate like or corresponding parts throughout the several views thereof, and wherein.

Figure 9:
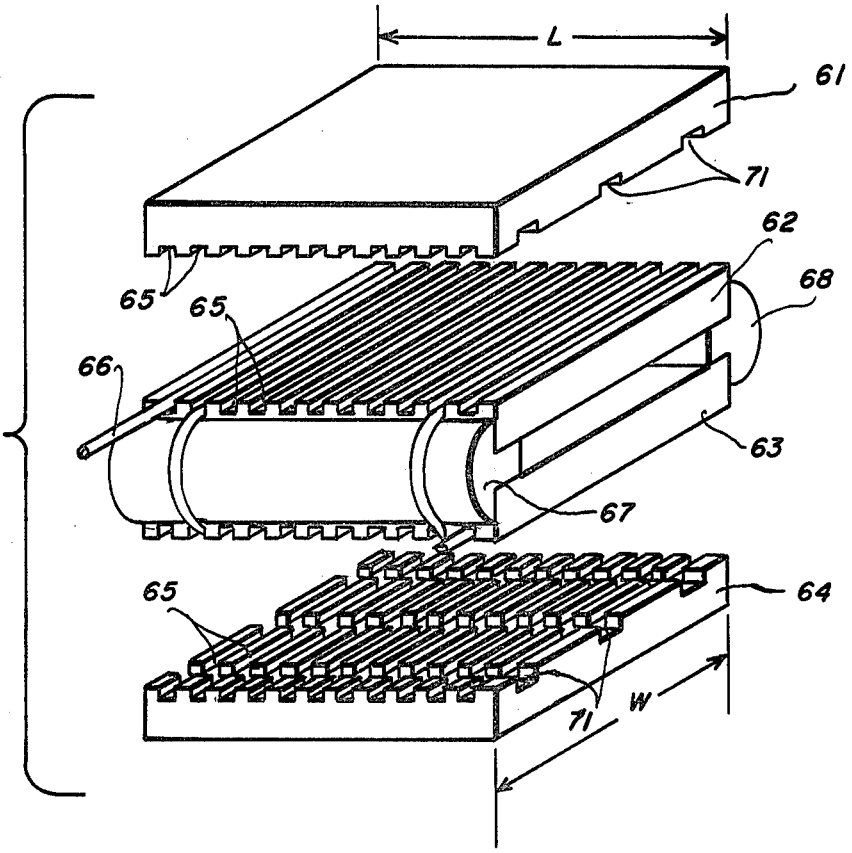
Figure 9A:
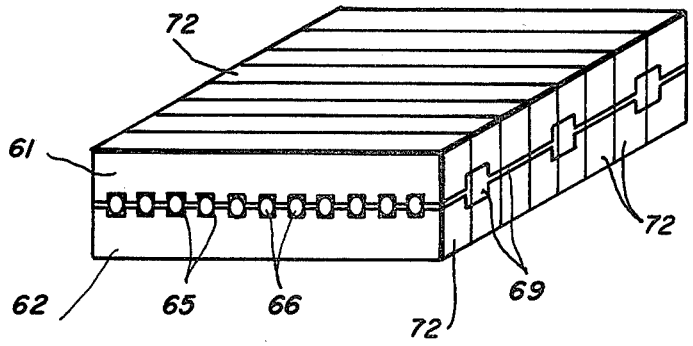
Figure 10:
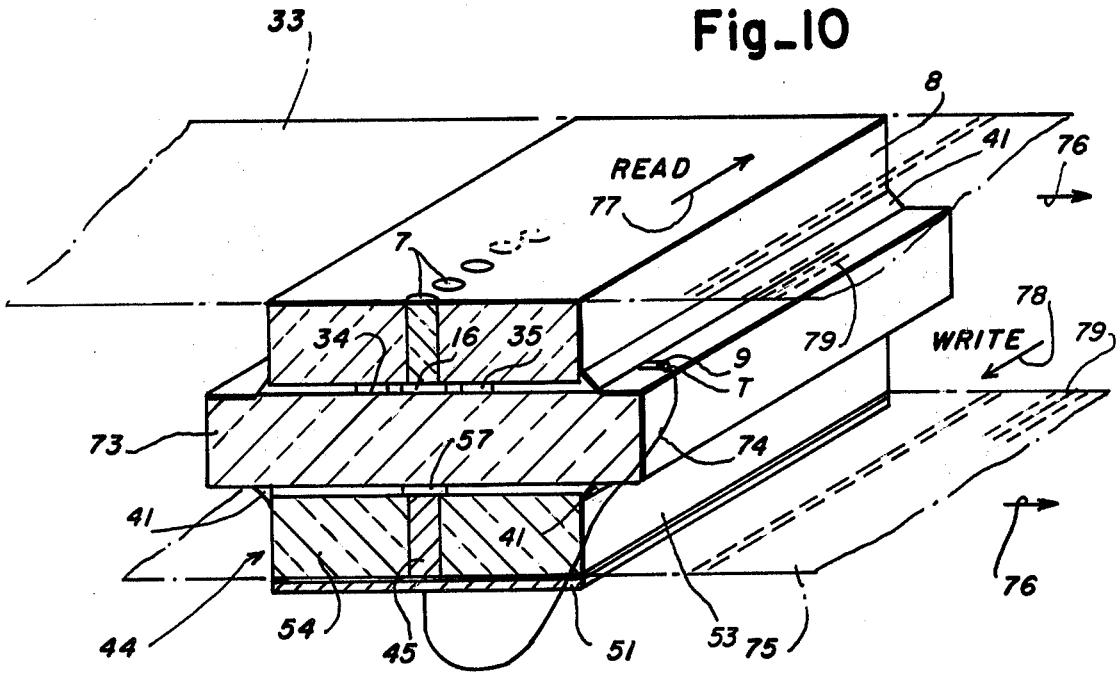

FIGS. 9 and 9*a* are views showing the method of making fiber optic and/or recording pin support subassemblies of the image converting and reproduction arrays; and FIG. 10 is a perspective view of an image converting and reproduction array on a common support particularly suited to a copy machine application.

Figure 1:
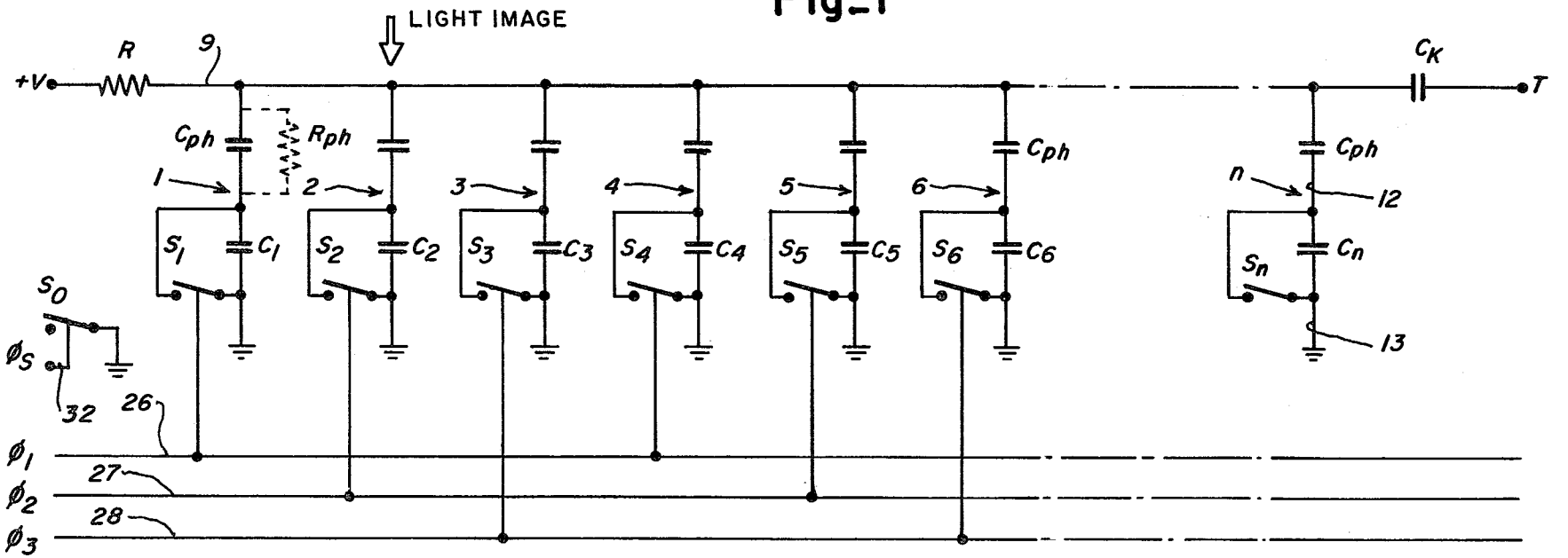
FIG. 1 is a schematic diagram of an image converter comprising an array of light responsive circuits in accordance with the invention.

Referring now to the drawing wherein like reference numerals designate like or corresponding parts throughout the several views there is shown in FIG. 1 a light to electrical image converter comprising an array of light responsive circuits generally designated by reference numerals 1, 2, 3, 4, 5, 6 - - - n.

Each of the light responsive circuits comprises the capacitance $C_{ph}$ and parallel resistance $R_{ph}$ of a discrete area of a layer of a photoconductive insulator in series with a capacitor C, which is shunted by a switch S. The circuits 1–n are connected in parallel across a d-c source voltage V via a common series resistance R. To scan the array, the switches $S_1$–$S_n$ associated with light responsive circuit 1–n are briefly closed, in turn, once each line scan. The closure of a switch S shorts its associated capacitor C with the result that it discharges and its associated capacitance $C_{ph}$ charges to the source voltage V over the interval of closure of switch S. When a switch S is opened there will occur over its switch open interval, a redistribution of charge between the capacitor $C_{ph}$ and the capacitor C, i.e. the charge on the capacitance $C_{ph}$ will be reduced in an amount proportional to the intensity of light incident on the associated discrete area of the photoconductive insulating layer, and the time between scans. Thus, on the next closure of the switch S associated with a discrete circuit, the magnitude of current necessary to recharge the capacitance $C_{ph}$ to source voltage V will be, as in a Vidicon image converter, a measure of the light incident on the photoconductive insulating layer over the switch open or line scan interval. As in a Vidicon image converter the output signals developed are passed to an output terminal T via a coupling capacitor $C_k$ for application to a local or remote recorder as is illustrated for example in FIG. 7.

Figure 2:
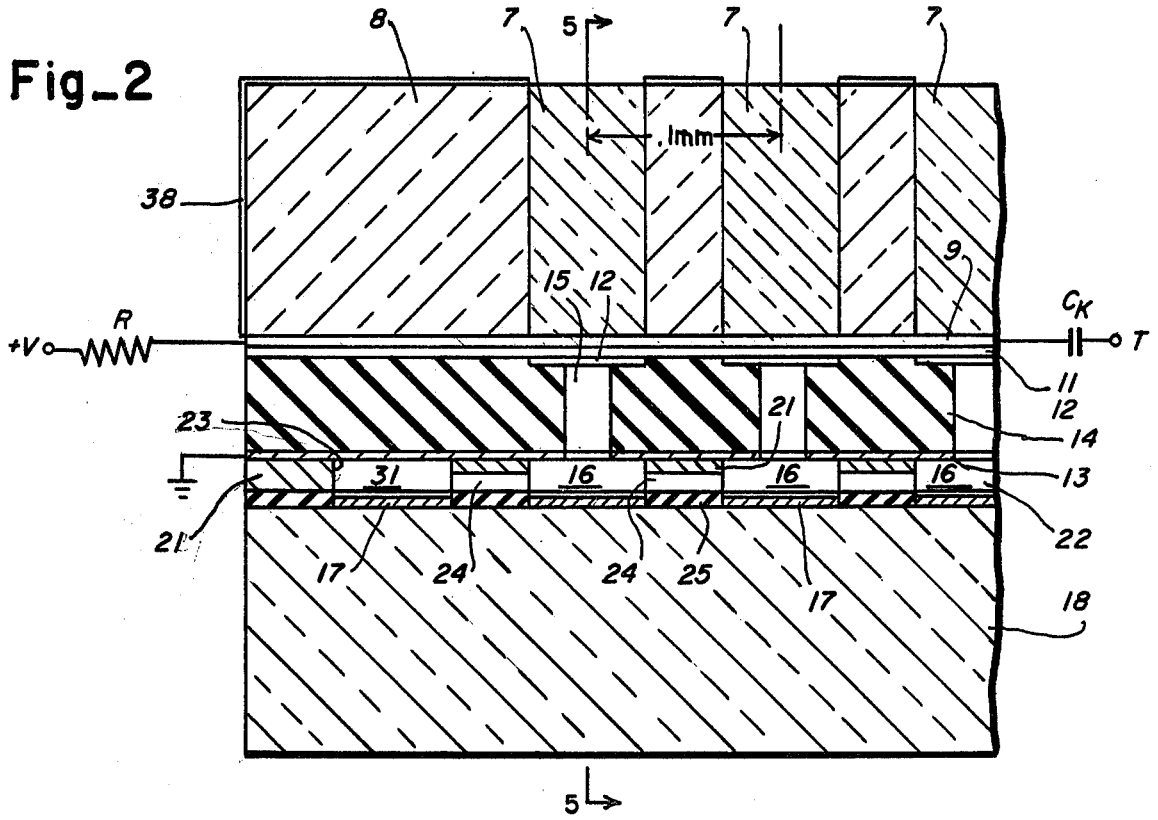
FIG. 2 is cross sectional view showing the physical construction of a portion of an image converter schematically shown in FIG. 1.
Figure 3:
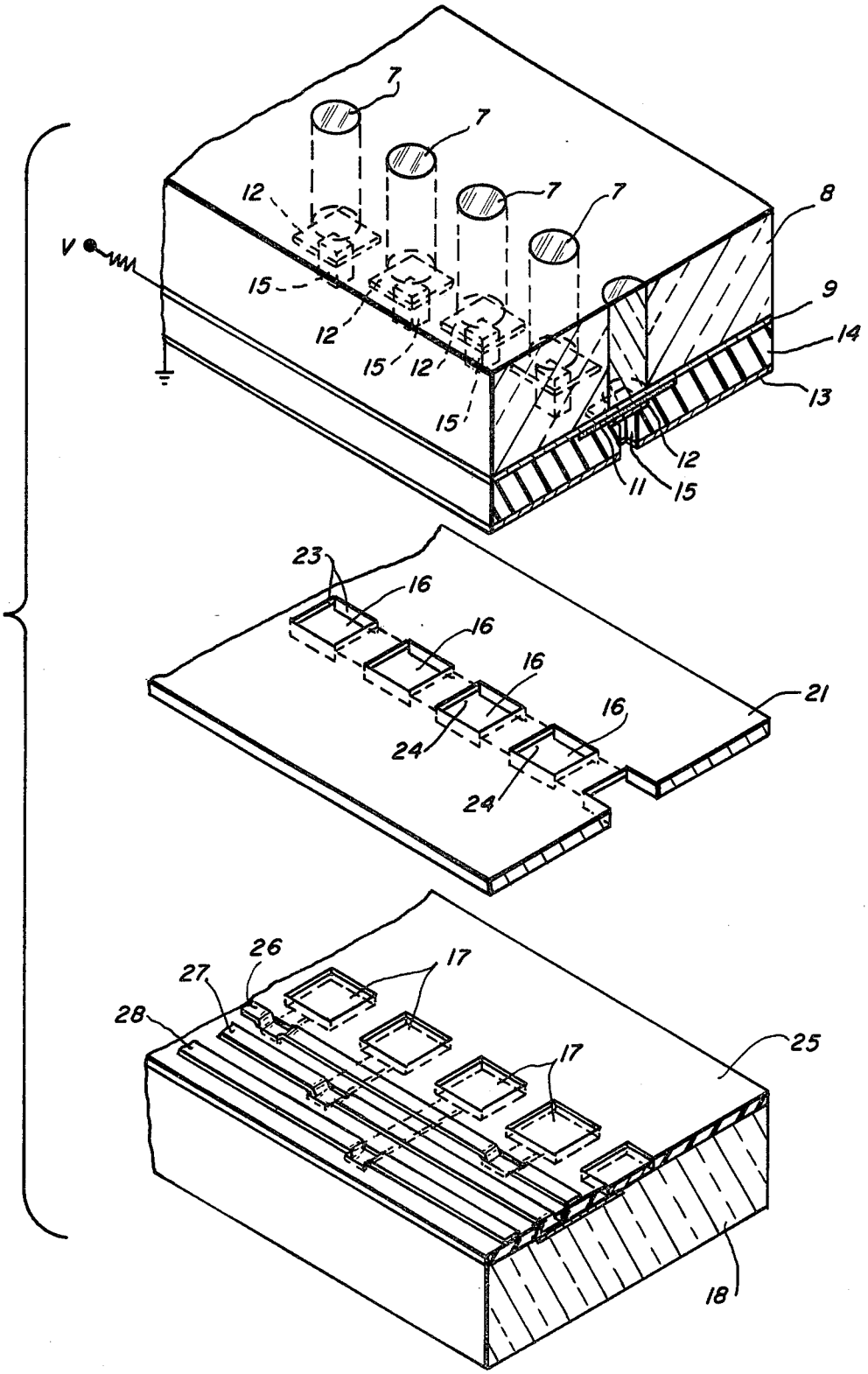
FIG. 3 is an exploded perspective view showing details of the construction shown in FIG. 2.

With reference to FIGS. 2 and 3 there is shown the construction of an image converter according to a preferred embodiment of the invention comprising an array of parallel fiber optic rods 7 of discrete cross sectional area fixed, in a manner hereinafter described, in a fabricated glass assembly 8. Coated on the lower side of the glass assembly 8 is a transparent conductive coating 9 on which a layer 11 of photoconductive insulating material is deposited. Coating 9 constitutes the upper plate of the parallel capacitances $C_{ph}$. On the side of the photoconductive insulating 11 layer opposite the conductive coating or signal electrode 9, coatings of conductive material constituting floating electrodes 12, are deposited over discrete areas coextensive with the cross sectional area of the fiber optic rods 7. With reference to FIG. 1 the floating electrodes 12 associated with each circuit represent the lower plate of capacitor $C_{ph}$, the upper plate of capacitor C and the left terminal of switch S.

A conductive coating 13 representing the lower plate of capacitor C or ground electrode is separated from the floating electrodes 12 by an insulating layer 14 of a material such as $SiO_2$. Opposite the center of each of the floating electrodes 12, the insulating layer 14 and the ground electrode 13 are etched through to the floating electrode 12, creating gas gaps 15 which, in conducting state, assume the function of switches S. The conductance of gas gaps 15 is controlled by gas discharges initiated in a gas chambers 16 which are controlled by application of negative read voltage pulses $\phi_1$, $\phi_2$, $\phi_3$ to electrodes 17 coated on a lower glass support plate 18. Electrodes 17 are positioned in alignment with floating electrodes 12 and are spaced from ground electrode 13 by the thickness of a perforated conductive plate 21 whose perforations 22 define the gas chambers 16 which are bounded vertically by electrodes 17 and ground electrode 13 and bounded laterally by the walls 23 of the perforations 22 in the plate 21.

As viewed in FIG. 2 and FIG. 3 channels 24 are etched through the walls 23 between perforations 22 of the plate 21 and connect one gas chamber 16 to its adjacent gas chambers 16. The perforated plate 21 is insulated from support plate 18 by insulating spacers 25. In FIG. 2 the relative dimensions are greatly enlarged for purpose of clarity of explanation. In practice the gas chambers 16 are on the order of 50–100 microns square and 30–50 microns high.

A gas discharge will occur between an electrode 17 as cathode and a grounded electrode 13 or perforated plate 21 as anode. The penetration of the discharge from cathode 17 to the floating electrode 12 is very small and the gas gap 15 is virtually decoupled from all processes in the gas chamber 16, unless there is a difference in potential between the floating and ground electrodes 12 and 13. In this event, a stray field from the edges of electrode 13 is effective into the gas gap 15 towards floating electrode 12. This causes a transport of charge carriers from the gas discharge in gas chamber 16 towards the electrode 12 until the potential difference between the electrodes 12 and 13 is equalized. As hereinbefore noted, this discharges capacitor C and causes the capacitance $C_{ph}$ to charge to the source voltage V. The charging current produces a voltage drop proportional to the intensity of light incident on the discrete area of the photoconductive insulating layer 11 during a scan interval which is coupled to signal output terminal T via a coupling capacity $C_K$. Since the measured signal is proportional to the quantity of incident light, a continuous halftone image reproduction is possible.

The time required to equalize the difference in potential between the floating and grounds electrodes 12 and 13 is a few hundred nano seconds so that the duration of the read pulses $\phi_1$, $\phi_2$, $\phi_3$ applied to electrodes 17 to read or scan the circuits 1–n can be less than one microsecond. The statistical potential deviation remaining at the floating electrode 12 after the gas discharge versus the electrode 13 at ground potential is less than 10 mV. As the useful signals are roughly 10 volts, signal-to-noise ratios of approx. 1000:1 (60 dB) can be realized.

A 1:1 image converter in accordance with the invention will be as wide as the width of an original document to be scanned. Thus to scan a Din A4 size page, the image converter will be 21 centimeters wide and, to realize a resolution of 10 dots per millimeter, will have 2100 discrete light responsive circuits 1–n arranged at 0.1 millimeter intervals.

As it is not practicable to employ 2100 discrete lines for application of voltage read pulses of sufficient magnitude to the 2100 electrodes 17, in turn, as will exceed the threshold of breakdown of the 2100 gas chambers 16 associated with each of the 2100 circuits, three lines 26, 27 and 28 are employed as shown in FIG. 1 to carry three phase read pulses $\phi_1$, $\phi_2$, and $\phi_3$.

Figure 4:
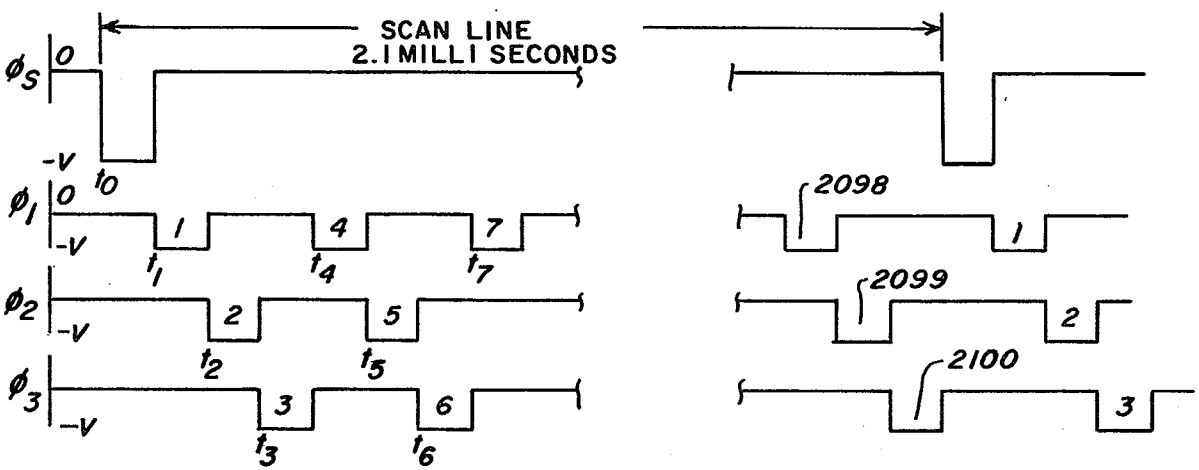
FIG. 4 is a pulse timing diagram for reading out or scanning each circuit in the array from left to right in turn.

The sequence of negative pulses $\phi_1$, $\phi_2$ and $\phi_3$, each, for example, of one microsecond duration as shown in FIG. 4, will read out the circuits 1–n at a one megahertz rate. More particularly, line 26 is connected to the first, fourth, seventh, etc. electrodes 17, line 27 is connected to the 2nd, 5th, 8th, etc. electrodes 17 and line 28 is connected to the 3rd, 6th, 9th etc. electrodes 17.

Further, in order that the information stored in the light exposed circuits 1–n of the array is read out of one ciruit at a time from 1–n, notwithstanding the application of a read pulse to every third circuit, the magnitude of the negative pulses $\phi_1$, $\phi_2$, $\phi_3$ on lines 26, 27, and 28 is normally less than the breakdown potential of the gas chambers 16 and thus will not cause a discharge unless the gas chambers 16 are primed. To prime each gas chamber 16 in turn, ions from a previously ignited gas chamber 16 are introduced into the next to be ignited gas chamber 16. The gas chamber 16 of the first circuit 1 is primed to initiate a line scan, by ions from a starting gas chamber 31 (FIGS. 1 and 2), located at the beginning of the array to the left of the first circuit 1. This starting gas chamber 31, designated switch $S_o$ in FIG. 1, which performs no read function, is caused to breakdown at time $t_o$ upon application to a line 32 (FIG. 1) connected to its electrode 17, of a 1 microsecond voltage start scan pulse $\phi_s$. The negative magnitude of the pulse $\phi_s$ is chosen to exceed the breakdown potential of starting gas chamber 31 whereby a discharge from electrodes 17 to 13 thereof occurs without delay, in that electrons are made available at the cathode 17 by field emission. The discharge thus triggered is completed after a few hundred nanoseconds. Sufficient ions from this starting gas chamber 31 are diffused through the channel 24 between the starting gas chamber 31 and the first gas chamber 16 of the circuit array, lowering its threshold of breakdown.

With reference to the pulse program shown in FIG. 4, after one 1 micro-second the starting voltage pulse $\phi_s$ is discontinued and a read voltage pulse $\phi_1$, of lower magnitude than pulse $\phi_s$, is applied at time $t_1$ to line 26. Due to the diffusion of charge via channel 24 between the start gas chamber 31 and the gas chamber 16 of the first circuit in the array, the voltage pulse $\phi_1$ on line 26 is sufficient to initiate a discharge in the first gas chamber 16. It is, however, insufficient to initiate breakdown in the gas chambers 16 associated with sensor circuits 4, 7, 10 etc., which not having being primed, continue to have a breakdown potential higher than the magnitude of the pulses $\phi_1$ applied to line 26. The discharge in the gas chamber 16 associated with the first circuit 1 brings its floating electrode 12 to ground potential, and at the same time ions diffuse through the channel 24 between the gas chamber 16 of the first circuit in the array to the gas chamber 16 of the second circuit 2 in the array. After 1 microsecond i.e. at time $t_2$ the voltage pulse $\phi_1$ is no longer applied to line 26. This quenches the discharge in the gas chamber 16 of the first circuit 1 in the array and a pulse $\phi_2$ is applied to line 27 at time $t_2$. The information stored in the primed second circuit 2 in the array is thus read out and the third circuit 3 is primed to be read, etc. with the pulses $\phi_1$–$\phi_3$ on lines 26, 27 and 28 causing gas discharges to shift from the gas chamber 16 of one sensor to another from left to right in turn.

It is noted that after the gas chamber 16 of the third circuit 3 in the array has fired, the gas chamber 16 of fourth circuit 4 in the array is primed and read upon receipt of a pulse $\phi_1$ at time $t_4$ on line 26, via which circuit 1 was read out earlier. However, circuit 1 is not again read, as any ions still present in its gas chamber 16, after its extinction at time $t_1$, is neutralized at the walls 23 thereof. Due to the very small size of the gas chambers 16, this process of neutralization is completed very quickly before the application of the next pulse on a given line, thus enabling the step-by-step continuation of the gas discharges with only three phase pulses $\phi_1$, $\phi_2$ and $\phi_3$ to be realized.

Thus a switch S can be closed only if an immediately previous switch S has been closed. After the last switch S associated with the last circuit, n, in the array is closed, a voltage pulse $\phi_s$ is again applied on start line 32 to initiate another scan of the array. As the circuits 1–n are addressed in turn, capacitors $C_{ph}$ are recharged consecutively to the level of the source voltage V from the decreased levels obtained during open switch intervals, thus producing individual signals at the output terminal, T, proportional to the intensity of light incident on discrete areas of the photoconductive insulating layer 11 during a line scan time. Accordingly, a line image is resolved or split into n discrete points with line feed being accomplished by moving the original being scanned.

Figure 5:
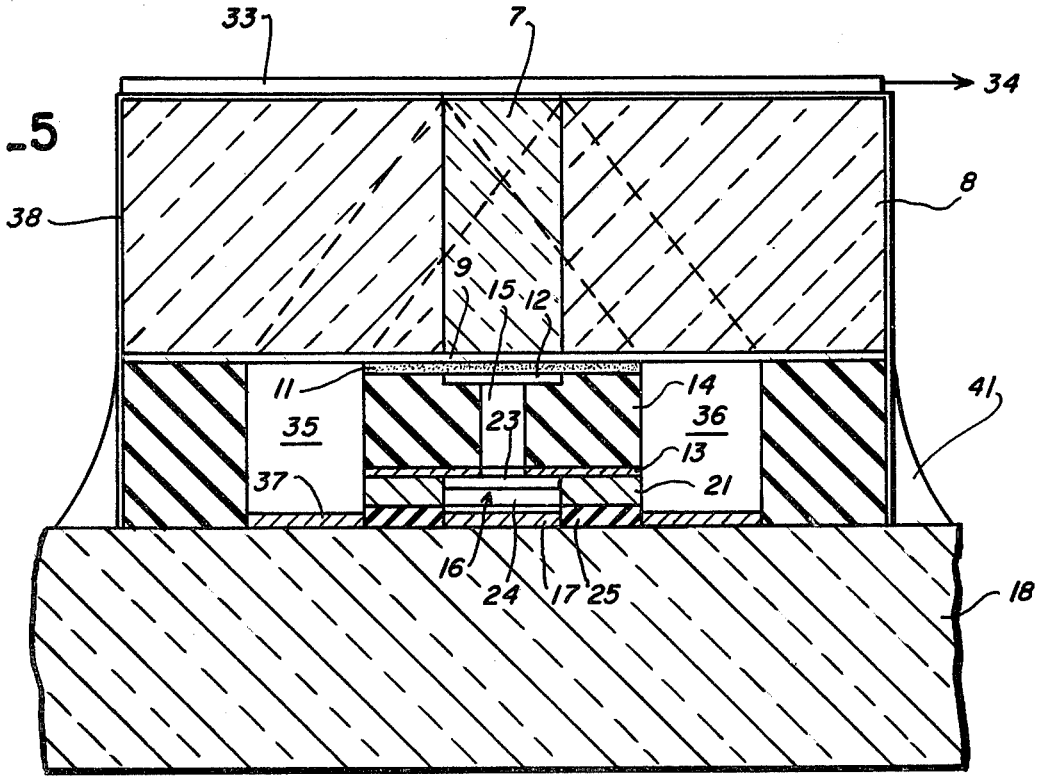
FIG. 5 is a cross-sectional view taken along lines 5—5 of FIG. 2 showing light sources for illuminating an original and fiber optics for conveying light reflected from the original to the circuits of the array.

With reference again to FIG. 2 and in particular to FIG. 5 there is shown the scanning array with an integrated space saving lighting system which makes a distortion free 1:1 exposure possible to the edges of a document 33.

As viewed in FIG. 5, the upper glass plate 8, which is fabricated as will hereinafter appear with reference to FIG. 9, supports the fiber optic glass rods 7 opposite elemental areas of the photoconductive insulating layer 11 to be read out. An original document 33 moving lengthwise at right angles to the line of the scanning array, i.e. in a direction indicated by arrow 34, is illuminated by two voltage ignited gas discharge chambers 35 and 36, bounded by the transparent electrode 9 and a reflecting metal electrode 37 coated on the lower support plate 18. The chambers 35 and 36 extend to either side of the line array of fiber optic rods 7 and the light therefrom is directed toward the original 33 and is reflected therefrom through the fiber optic rods 7 and transparent electrode 9 to thereby expose the underlying discrete elemental area of the photoconductive insulating layer 11. Further, as shown in FIG. 5 a light absorbing coating 38 is applied to the upper glass plate 8 except where the fiber optic rods 7 penetrate the surface of the glass assembly 8. Due to the close spacing of the light sources 35 and 36 (3 mm approx.) the intensity of the exposure of the original 33 is relatively high.

Figure 6:
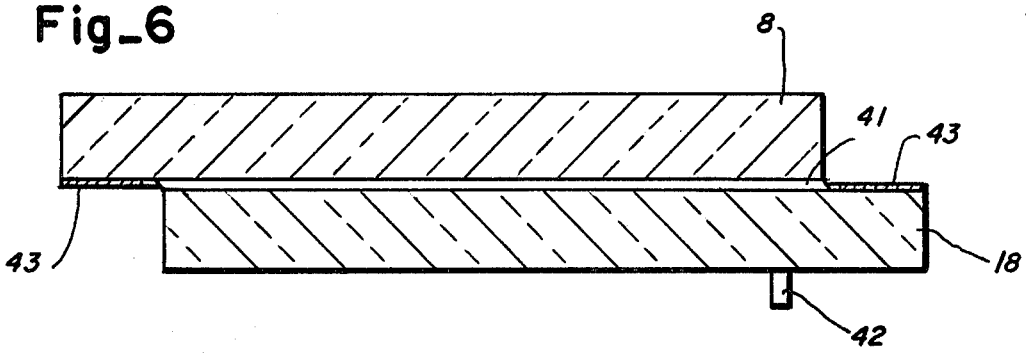
FIG. 6 is an elevational view of the image converter apparatus.

With reference to FIG. 6 after completion of the elements of an array on the glass support plate 18, the fabricated glass assembly 8 supporting the fiber optic rods 7 is adjusted over and glued to the glass support plate 18 by means of an epoxy resin 41, after which gas chambers 16 in the assembly are evacuated through a pump nipple 42, and filled with gas, such as neon +0.1% argon to approximately 1 atmosphere of pressure after which the pump nipple 42 is melted off. The leads applied to the glass assembly 8 and support plate 18 in the form of thin films, as described with reference to FIGS. 1, 2, and 3 run below the epoxy resin layer 41 and form external terminals collectively designated by reference 43.

Figure 7:
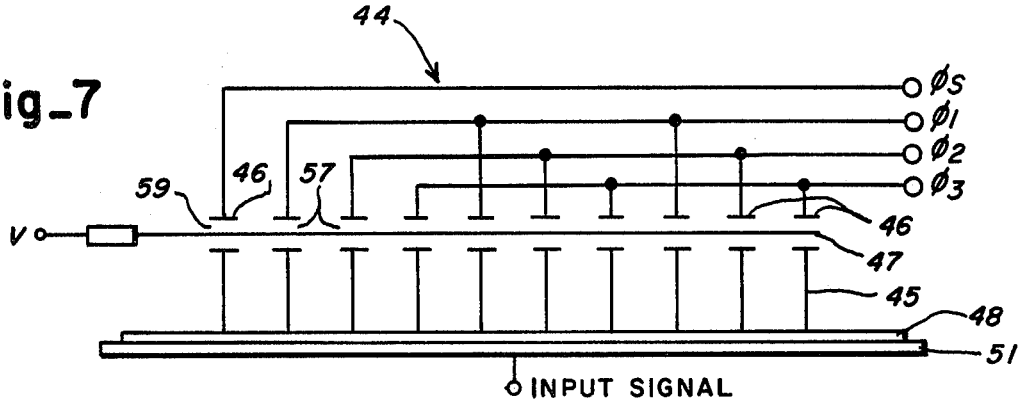
FIG. 7 is a schematic circuit diagram of a reproduction array known to the art.

Referring now to FIG. 7 there is shown a schematic of a reproduction unit, generally designated by reference numeral 44 for recording signals generated by the image converter. The reproduction unit 44 comprises an array of metal recording pins 45 corresponding in number to the circuits 1–n of the image converter. The pins 45 are selected in turn, after a negative start pulse $\phi_s$ is applied, by application of three phase negative pulses $\phi_1$, $\phi_2$, $\phi_3$ to cathodes 46 to effect gas discharges to a common anode 47 in a manner similar to that described with reference to the scanning array of FIGS. 1 and 2. The operation of such a reproduction array 44 is more particularly described in the IEEE Transactions on Electron Devices, Vol. Ed.-21 No. 9, September 1974 on p.93 by Terazawa et al. which is incorporated by reference herein. The recording pins 45 are spaced a short distance from a dielectric paper copy sheet 48 on a conductive plate electrode 51 to which the serially generated dot video signals from the output terminal T (FIG. 1) of the image converter to be recorded are applied. The recording pins 45 are maintained during discharge at a voltage higher than the cathode 46 and, if the potential between a recording pin 45 and electrode 51 exceeds the breakdown potential of the air gap between recording pin and recording paper 48, discharge occurs with the result the dielectric paper 48 is charged in an amount related to the magnitude of the dot video signal. The charge pattern can later be developed as known in electrophotography.

Figure 8:
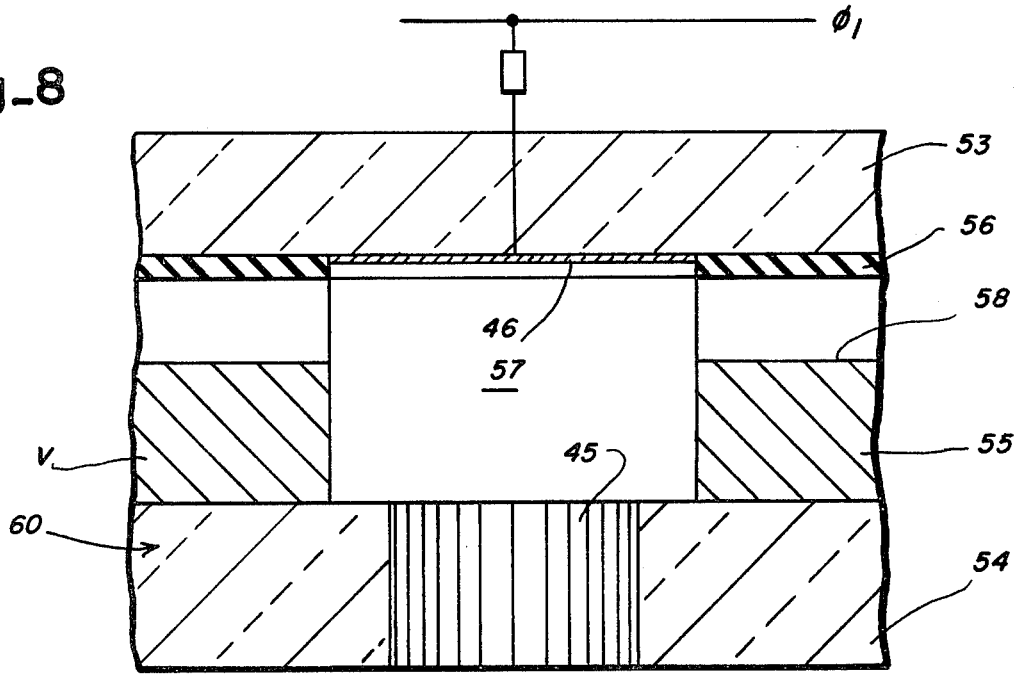
FIG. 8 is an elevational view showing the physical construction, in accordance with the invention, of a portion of the reproduction array schematically shown in FIG. 7.

Referring to FIG. 8 there is shown a portion of the physical construction of a reproduction unit, including a recording pin 45, in accordance with the invention. As shown the cathodes 46 comprise films of discrete area deposited on a glass support plate 53. A recording pin 45, coextensive in cross sectional area with cathodes 46, arrayed with others in an insulating glass plate 54, is spaced from the cathode 46 by a perforated conductive plate 55 similar to plate 21 in FIG. 2 and which is insulated from the cathode 46 by an insulating layer 56. The perforations in the plate 55 which constitutes the anode 47 in FIG. 7 define gas chambers 57 associated with each recording pin 45, and each gas chamber 57 communicates with adjacent chambers 57 by means of interconnecting channels 58 whereby each chamber 57 may be primed in turn by discharge in an earlier chamber 57 in the array as described in the image scanning array of FIG. 2. As in the image converter array a starting gas chamber 59 (FIG. 7) to the left of the recording pin array starts a scan when a pulse $\phi_s$ is applied to its cathode 46.

It is apparent that the construction of the reproduction unit 44 as shown, has elements identical in construction and geometry to elements of the image converter of FIG. 2. More particularly, the glass support plate 53, cathodes 46, gas chambers 57, perforated plate 55 with channels 58 to diffuse ions, and the insulating spacers 56 of FIG. 8, are identical to the glass support plate 18, cathodes 17, gas chambers 16, perforated plate 21, channels 24 and insulating spacers 25 of FIG. 2, thus offering manufacturing efficiencies.

As shown in FIG. 8 the recording pins 45 are supported in a fabricated glass assembly 60 which is substantially similar to the glass assembly 8 supporting the fiber optic rods 7. Both therefore lend themselves to fabrication by the same production technique as shown in FIGS. 9 and 9*a* to which reference is now made.

As shown in FIG. 9 glass plates 61, 62, 63 and 64 of approx. 5 mm thickness having a length L and width both about 10 mm more than the width of the original document 33 to the copied i.e. 210+10=220 mm, for DIN A4 size paper. One surface each of the plates 61–64 is provided, using photolithographic techniques, with grooves 65, the depth of which is smaller than the radius of strands 66 (fiber optic or metal wire strands) used, and the width of which roughly matches the diameter of the strands 66. The center distance of the grooves 65 corresponds to the specified dot resolution, i.e. 10 grooves/mm, for instance. By means of spacing fixtures 67 and 68, which resemble semicylinders, the middle plates 62 and 63 are fixed so that their grooves 65 face outwardly. The radius of the fixtures 67 and 68 is greater than the smallest permissible bending radius of the strands 66 used. In manufacture the grooves 65 are filled with epoxy resin 69 and wound with a continuous strand 66 so that a length of the strand 66 is placed in each groove 65. Next, the grooves 65 of plates 61 and 64 are also filled with epoxy resin and pressed groove side toward the strand wound plates 62 and 63 so that the wound strand 66 fits in the grooves 65 of plates 61 and 64. To absorb excess epoxy resin 69 and displaced air, the plates 61 and 64 are provided with parallel, transverse slots 71 approx. 1 mm wide 0.5 mm deep, and approx. 3 mm apart.

After the epoxy resin 65 has set and the fixtures 67 and 68 are cut away, two identical pairs of plates 61–62 and 63–64 are obtained. One pair, 61–62, is shown in FIG. 9*a* from which strips 72 are sawed at right angles to the strands 66 in the transverse slots 65. After grinding and polishing the sawed surfaces, more than 100 fabricated glass strip assemblies are obtained as shown in FIG. 9*a* whose cut strands, either fiber optic rod 7 or metal pin 45, are supported at the proper spacing by the grooves 65. Each strip assembly thus constitutes either the fiber optic rod assembly 8 of FIG. 2 or the metal pin assembly 60 of FIG. 8.

The structures of the image converter not common to the reproduction array are produced by well known thin-film techniques and photolithographic methods.

Referring now to FIG. 10 there is shown a back to back arrangement of an image converting unit and a reproduction unit 44 carried on the upper and lower surfaces of a common support plate 73. Signals at the output terminal T of the converter are connected over line 74 to electrode 51 of the reproduction unit 44.

As shown an original document 33 to be scanned or read will be moved, message side down, across the line of the array of fiber optic rods 7 and a copy document 75 on which the message on the original document is to be reproduced will be moved, message side up, across the line of the array of recording pins 45. If the original and copy documents 33 and 75 are moved in the same direction indicated by arrows 76, the original document 33 will, as viewed in FIG. 10, be read or scanned in a left to right direction 77, and the copy document 75 written on in a right to left direction 78 in order that a right reading copy of the message 79 on document 33 will be recorded. On the other hand if the original and copy documents 33 and 75 are moved in opposite directions the original and copy documents will both be read and written in the same left to right direction to produce a right reading copy document.

For design flexibility it will be appreciated that the direction of the gas discharges can be controlled from n–1 as well as from 1–n simply by providing auxiliary starting gas chambers 35 at both ends of the arrays. Thus if the gas discharges are to run from right to left instead of from left to right as heretofore described, then the auxiliary starting gas chamber on the right side is ignited for each start and the pulse sequence $\phi_1$, $\phi_2$, $\phi_3$ reversed to $\phi_3$, $\phi_2$, $\phi_1$.

The invention claimed is:

1. An image converter for generating a signal proportional to light incident thereon comprising a first light responsive capacitor, a second capacitor connected in series with said first capacitor across a voltage source whereby the charge distribution in said capacitors is proportional to light incident on said first capacitor, means for shorting out said second capacitor whereby said first capacitor charges to the voltage of said source, and means for measuring the change in voltage across said first capacitor.

2. An image converter for storing charges proportional to the quantity of light incident on elemental areas of a photoconductive insulating layer and for reading out the stored charges comprising a voltage source, an array of circuits connected in parallel across said voltage source, each of said circuits having a first capacitor defined by an elemental area of said photoconductive layer, a second capacitor connected in series with said first capacitor, the charges stored in said first and second capacitors being related to the quantity of light incident on an elemental area of said photoconductive insulating layer over a predetermined exposure interval, and switch means operable when closed to short said second capacitor, readout means for closing said switch means in said array of circuits, in turn, over predetermined intervals during which said first capacitors charge to said source voltage from the charge levels obtained during open intervals of said switch means, and means for coupling changes in the level of charge on said first capacitors during said predetermined closed switch intervals to an output terminal.

3. An image converter as recited in claim 2, each of said switch means comprising an enclosure containing an ionizable gas, associated ones of said second capacitors having plates exposed to said gas within said enclosures, and read electrodes in said enclosures exposed to said gas, said readout means applying read pulses to said read electrodes in turn to initiate ionization in said enclosures thereby to effect discharge of said second capacitors.

4. An image converter as recited in claim 3, said readout means for closing said switch means in said array of circuits, in turn, comprising three read pulse carrying lines, said lines being connected respectively to the first, second and third read electrodes of said array of circuits and to every third read electrode thereafter in said array of circuits for ionizing the gas in primed enclosures, a starting gas enclosure, means for initiating a discharge in said starting enclosure, and channels interconnecting all of said enclosures whereby a discharge in one enclosure will prime the next following enclosure.

5. Apparatus for reading a relatively moveable document comprising an array of uniformly spaced light responsive elements extending perpendicular to the direction of movement of said document, a line light source for exposing said document, said array of elements comprising, a transparent support having on one surface a transparent electrode, a plurality of second electrodes corresponding to elements in said array, a photoconductive insulating layer sandwiched between said transparent and said second electrodes defining first capacitors for receiving light reflected from said document, a third electrode, an insulating layer sandwiched between said second electrodes and said third electrode defining second capacitors in series with said first capacitors, said insulating layer and third electrode opposite said second electrodes having aligned perforations defining gas gaps, a base support, fourth electrodes on said base support corresponding in number to said perforations, means spacing said third electrode and said fourth electrodes to define a plurality of gas chambers in communication with said gas gaps, an ionizable gas in said gas gaps and gas chambers, a source voltage, means for connecting said source voltage across said transparent and third electrodes, whereby the resulting current flow distributes charge in said first and second capacitors according to the light quantities incident on said photoconductive insulating layer from said document, means for applying voltage pulses over predetermined intervals to said fourth electrodes, in turn, to initiate ion transfer across said gas chambers and said gaps thereby to short and discharge said second capacitors and to charge said first capacitors to said source voltage, and means for coupling the voltage charges across said first capacitors during said predetermined intervals to an output terminal.

6. Apparatus as recited in claim 5, every third of said fourth electrodes being interconnected, said means for applying voltage pulses in turn to said fourth electrodes comprising means for first introducing ions into each gas chamber in turn whereby only chambers with ions can be discharged by said applied pulses.

7. Apparatus as recited in claim 5 said second electrode having an area coextensive with that of the gas chamber.

8. Apparatus as recited in claim 5, said transparent support having optical fibers equal in number to said gas chambers for conveying reflected light to elemental areas of said photoconductive insulating layer.

9. Apparatus as recited in claim 5 said line light source comprising elongated gas chambers parallel to said element array, said elongated gas chambers being bounded by said first transparent electrode and by a light reflecting electrode on said base support.

* * * * *